US005191167A

United States Patent [19]

Beyer

[11] Patent Number: 5,191,167

[45] Date of Patent: Mar. 2, 1993

[54] MULTI-POINT FIBER OPTIC IGNITER

[75] Inventor: Richard A. Beyer, Baltimore, Md.

[73] Assignee: The United States of America as represented by the Secretary of the Army, Washington, D.C.

[21] Appl. No.: 890,429

[22] Filed: May 29, 1992

[51] Int. Cl.[5] ..... F42C 19/08

[52] U.S. Cl. ..... 102/201

[58] Field of Search ..... 102/201

[56] References Cited

U.S. PATENT DOCUMENTS 3,812,783 5/1974 Yang et al. ..... 102/201

4,391,195 7/1983 Shann ..... 102/201

4,892,037 1/1990 Betts ..... 102/201

*Primary Examiner*—Harold J. Tudor

*Attorney, Agent, or Firm*—Saul Elbaum; Muzio B. Roberto

[57] ABSTRACT

A method and system for the Multi-Point ignition of a propellant of an explosive material comprising the steps of: selecting an elongated optic fiber; attaching a suitable energetic material at several sites thereon, irradiating on end of the optic fiber so that light energy is transmitted through the optic fiber and exited at the site of the sensitive material to ignite the material.

9 Claims, 1 Drawing Sheet

MULTI-POINT FIBER OPTIC IGNITER

RIGHTS OF THE GOVERNMENT

The invention described herein may be manufactured, used, and licensed by or for the Government for Governmental purposes without the payment to me of any royalties thereon.

BACKGROUND OF THE INVENTION

1. Field of Invention

This invention relates to an ignition system and method for providing multi-point simultaneous ignition to energetic materials from a single robust fiber optic. Primary application is to the ignition of explosives and propellants.

2. Description of Related Art

The use of Lasers for ignitors and initiators of energetic materials is known. Multiple-point Laser ignition and initiation is presently accomplished by using multiple fibers or bifurcated fibers, i.e., fibers which are split to have one input and multiple output, each of which terminate at an ignition/initiation point. At that point, the light energy which has been transported through the fiber, exits and is absorbed by the energetic material. The multiple fibers may be connected to a single Laser, or to multiple lasers where it would be advantageous to provide a difference in timing of ignition or initiation of the explosive matter.

SUMMARY OF INVENTION

The present invention provides for multi-point ignition or initiation of an explosive or propellant using a single non-branching optical fiber in lieu of multiple or bifurcated/multi-furcated, thus allows ready configuration for a number of ignition or initiation points well in excess of multiple fiber configuration.

DESCRIPTION OF PREFERRED EMBODIMENT

Figure 1:
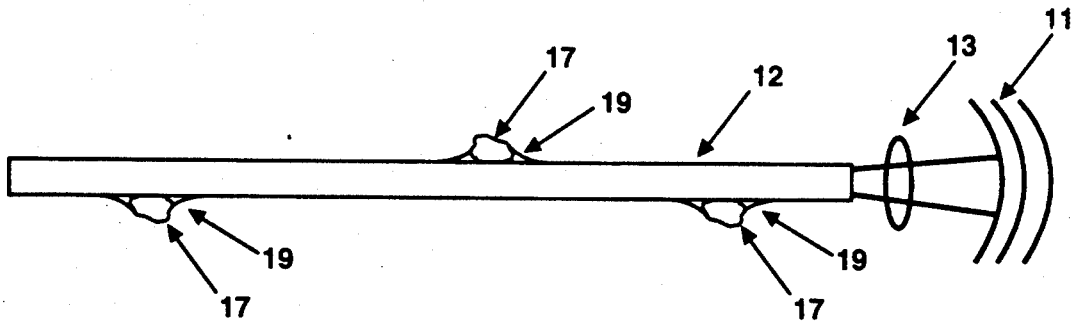
FIG. 1 is a schematic of the system

Referring now to FIG. 1 of the drawing, light from Laser 11 is coupled into fiber optics 12 through lens 13. The lens can be conventional or have a gradient index of refraction. Once light enters a suitably constructed optical fiber, it is transmitted only down the fiber and not through the wall, because the index of refraction change at the surface causes total internal reflection of any light that strikes the side walls. This phenomenon occurs only over a limited angle (ca. 22 degrees full angle for fused silica fibers). Lens 13 is chosen so that the maximum amount of light is transmitted. As a typical light beam travels down a fiber, it repeatedly reflects off the side wall. At a point along the fiber where an event is to be initiated, a sufficiently sensitive material 17 is attached with a optically transparent epoxy glue which is chosen to match the index of the fiber optic material. The index of reflection causes a partial coupling of the light energy out of the fiber, i.e., much of that fraction of the total light which would normally be reflecting off the wall in the region of the glue does not reflect internally, but is transmitted with the glue. At the interface of glue 19 and sensitive material 17, the light goes through the interface because, a) the angle is not sufficiently oblique for internal reflection and/or, b) the index refraction change is not sufficiently great. The fraction of total energy passes out of optic fiber 12 and onto the surface of sensitive material 17 where it is absorbed and ignites the material. Due to the speed of light propagation of the Laser energy, each of the initiation points is irradiated at virtually the same time, i.e., within about 10 nanoseconds for a two meter fused silica fiber).

Figure 4:
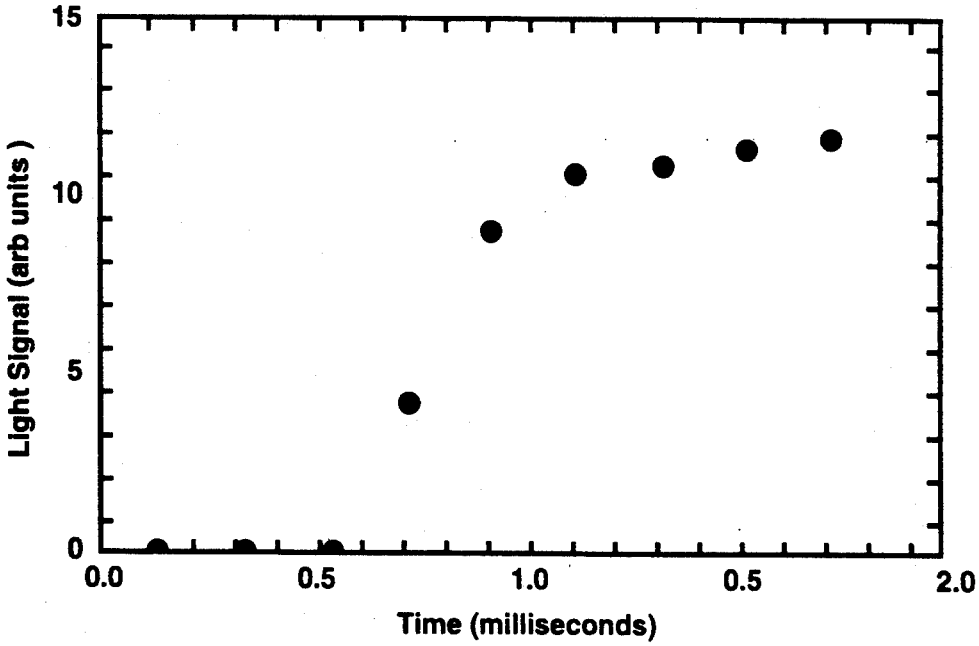
FIG. 4 shows light signal from ignition of a black powder grain mounted on a fiber, as function of time after Laser pulse.

Practical limitations on simultaneity arises from response of the material used. Observations made with black powder have shown that times to full ignition under one millisecond can be obtained. A sample trace is shown in FIG. 4. In this Figure, ignition is seen to occur in less then 0.7 milliseconds. (Ignition and light emission are essentially simultaneous on these time scales).

Figure 2:
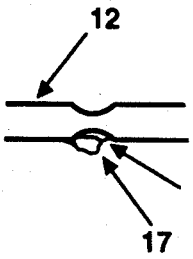
FIG. 2 is an alternative of the system of FIG. 1 showing a Tapered Fiber Optic.
Figure 3:
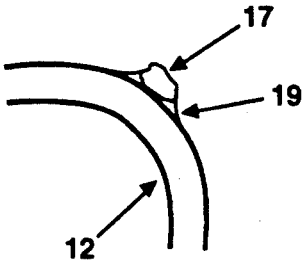
FIG. 3 is another alternative of FIG. 1 showing a Bent Fiber Optic.

When greater light intensity is required at specific points, the fraction of the Laser light coupled out at an initiation site can be increase up to more than half the transmitted light at that point by use of a relatively sharp taper (FIG. 2) in the fiber at the point of mounting or by pre-bending the fiber (FIG. 3) at the point of attachment. In either case, the number of possible sites is reduced, but other advantages of a single robust fiber are retained.

EXAMPLE

A fiber optic made of a fused silica with a nominal diameter of 1.0 millimeter and a length up to 1 meter was used. Fiber length is not important, except that when the fiber is less than 30 centimeters, care must be taken to obtain conditions such that the light travel down the fiber is random and coupling can be obtained at any point. Longer fibers randomize the light distribution and allow sidewall output coupling at any point. The fiber used was a single index of refraction material. The index of refraction change required for total internal reflection was provided by fused silica-air interface.

A ultraviolet curing epoxy designed for use in optical assemblies was used to attach the sensitive material to the optic fiber. It is sold under the tradename of Norland Optical Adhesive #61 (Norland Products, New Brunswick, N.J.).

The Laser utilized was a commercial neodymium glass Laser with a wavelength of 1.05 micrometers. Pulse energy and length were about 9 joules into the fiber in about 10 milliseconds. The pulse energy and pulse length were both much more than required since the black powder ignites in about 0.5 millisecond or less. Laser light was focussed into the fiber optic with a 2 inch focal length lens.

The sensitive material used was black powder with a typical maximum dimension of 2 to 3 millimeters with a mass of approximately 10 milligrams. The system was assembled by placing drops of the epoxy glue on the side of the fiber, and placing black powder grains into the glue. The glue was cured under a ultraviolet for a period of about several minutes.

Observations were made with linear high speed photography and photomultiplier tubes recording light emission which is indicative of ignition. The light signal from one position of a linear photography record is shown in FIG. 4. In this case, the light detected by a line scan camera at the position of a black powder grain is plotted versus the time after start of the Laser pulse.

The device of the present invention is suitable for other commercial applications addition to gun ignition. By strongly confining an appropriate sensitive material in a metal tube, the ignition results in combustion known as deflagration-to detonation transition. This process results in a full detonation wave at the exit end of the tube. This detonation wave would be suitable for initiation of explosives. In many commercial applications, such as demolition, simultaneity of the initiation of the explosive charge would be advantageous. The present invention possesses the additional advantageous of significant safety because of the use of optical fibers rather than electrical wires to start initiation of the explosives.

Having described my invention, I claim:

1. A method for the multi-point ignition of a sensitive energetic material, comprising the steps of:

a) selecting an elongated single non-branching optic fiber, b) selecting a sensitive energetic material, c) adding an epoxy glue to the side of the optic fiber at several sites in an amount sufficient to attach the sensitive energetic material so as to form an exit for light energy.

d) attaching the sensitive energetic material to the optic fiber, and e) irradiating the optic fiber so as to transmit light energy along the fiber optic to the exit formed by the attached sensitive energetic material, and f) igniting the sensitive energetic material.

2. A method in accordance with claim 1, wherein the sensitive energetic material is an explosive.

3. A method in accordance with claim 1, wherein the explosive is black powder.

4. A method in accordance with claim 1, wherein the optic fiber is tapered at the point of contact with the sensitive energetic material to achieve greater light intensity threat.

5. A method in accordance with claim 1, wherein the optic fiber is bent at the point of contact with the sensitive energetic material in order to achieve greater relative light intensity threat.

6. An system for the multi-point ignition of a sensitive energetic material comprising:

a) an elongated single non-branching optic fiber, b) a sensitive energetic material attached by an epoxy glue to the optic fiber at several points along its length.

b) irradiation means positioned at one end of the optic fiber, c) lens means positioned between the irradiation means and one end of the optic fiber, so that on the irradiation of an end of the optic fiber, light energy is transmitted along the optic fiber and exits at the point of the attached sensitive energetic material.

7. A system in accordance with claim 5, wherein the irradiation means is a laser.

8. A system in accordance with claim 5, wherein optic fiber is tapered at the point of contact with the sensitive energetic material in order to achieve greater light intensity.

9. A system in accordance with claim 5, wherein the optic fiber is bent at the point of contact with the sensitive energetic material in order achieve greater light intensity.

* * * * *